United States Patent [19]

Alam

[11] Patent Number: 4,685,247

[45] Date of Patent: Aug. 11, 1987

[54] SAFETY BARRIER

[76] Inventor: Aftab Alam, 43 Colwyn Road, Leeds LS11 6LQ, West Yorks., England

[21] Appl. No.: 862,283

[22] Filed: May 12, 1986

[30] Foreign Application Priority Data

May 14, 1985 [GB] United Kingdom ..... 8512231
Jul. 2, 1985 [GB] United Kingdom ..... 8516716

[51] Int. Cl.[4] ..... E06B 9/04
[52] U.S. Cl. ..... 49/55; 49/57
[58] Field of Search ..... 49/50, 55, 56, 57; 160/225

[56] References Cited

U.S. PATENT DOCUMENTS 4,583,715 4/1986 Wright ..... 49/55 X

FOREIGN PATENT DOCUMENTS 2357660 5/1975 Fed. Rep. of Germany ..... 49/55
2058186 4/1981 United Kingdom ..... 49/55

*Primary Examiner*—Kenneth Downey
*Attorney, Agent, or Firm*—Henry Sternberg; Bert J. Lewen

[57] ABSTRACT

This invention is related to a safety barrier positionable in a doorway or passageway to prevent the passage of small children or animals. The barrier comprises a frame assembly having a substantially rectangular structure with upper (4, 5, 16) and lower (1) frame elements, each extending from one side of the passageway to the other. The frame assembly is provided with independently adjustable clamping means (12, 13, 14, 15) at each corner thereof for securing within the passageway. At least a portion of the frame assembly is in the form of a gate which is openable to allow access through the barrier. The gate is provided with further clamping means (22) to lock the openable portion in its closed condition, said further clamping means acting to increase the overall stability of the barrier within the passageway.

9 Claims, 6 Drawing Figures

SAFETY BARRIER

In order to prevent passage of small children or small animals, safety barriers are positioned across doorways, stairways and so forth. When an adult wants to pass through doorways or stairways the safety barriers are removed. Removing the barrier for passage and repositioning it after passage is time-consuming, and accordingly there is a temptation to climb over the barrier. Climbing over the safety barrier is difficult and there is also a risk of tripping over it.

In British Patent Application No. 2088939 there is disclosed a gate which is positionable in a doorway. The gate is openable to allow access through the doorway and can be transferred to different doorways when required. However, the device is only suitable for positioning in a doorway and cannot be located in a passageway by being connected to the surrounding walls due to the method of clamping the structure in position. The method of clamping requires the structure to be screwed to the upright of a door frame thereby permanently marking the door jamb. The device cannot, for example, be positioned at the top of a flight of stairs if there is no doorway there and therefore this device is not very versatile.

In British Patent Application No. 2058186 there is disclosed a safety barrier positionable in doorways, stairways and so forth. This gate is readily openable to allow access therethrough and can be moved from one location to another without damaging walls or doorways. This device, however, requires a sturdy construction which will withstand force applied thereto without tilting or shifting its position. Consequently this safety barrier has to be made of materials which are both expensive and heavy such that the gate as a whole is of unwieldly construction. For example, the drawings show that the barrier comprises wooden uprights 2 of relatively large cross section, a base 4 of large cross section, a U-section metal reinforcing member 5 and subframe members 47. Therefore the assembly as a whole is bulky, heavy and not easily moved by old or weak people.

According to the present invention there is provided a child safety barrier intended for positioning in a passageway, doorway or the like comprising a frame assembly, said frame assembly having a substantially rectangular structure with upper and lower frame elements, each extending from one side of the passageway to the other, said frame assembly being provided with independently adjustable clamping means at each corner thereof for securing within the passageway, at least a portion of said frame assembly being in the form of a gate openable to allow access through the barrier, said gate being provided with further clamping means to lock the openable portion in its closed condition, said further clamping means acting to increase the overall stability of the barrier within the passageway.

The further clamping means acts between the openable portion and the remainder of the frame assembly in the closed condition thereby supplementing the effect of the upper clamping means and increasing the stability of the barrier within the passageway.

The clamping means, when engaged, exert outward compressive pressure.

Preferably the frame includes upper and lower frame elements, each extending from one side of the passageway to the other when the gate is in its closed position and at least a portion of the upper frame element forms part of the gate. The upper and lower frame elements, with their associated clamping means form the basis for a very sturdy structure. The gate may be located at one side of the frame or it may be located centrally.

Preferably the barrier comprises two coplanar rectangular frame members separated in their common plane but interconnected by means of the lower frame element, the gate being hingedly attached to one of the rectangular frame members and clampable to the other by the further clamping means, the further clamping means tending to urge apart the two rectangular frame members thereby counteracting the tendency of the frame assembly to bend inwardly due to the action of the clamping means on the sides of the passageway.

Preferably the barrier includes at least one lateral extension member connectable to a side thereof, and more preferably the arrangement is such that the extension member may be mounted between the barrier clamping means and the main body of the barrier. The combination of extension members and barrier clamping means enables the barrier to be accommodated in passageways of varying, and non-uniform, widths.

Preferably each barrier clamping means comprises a member projecting laterally from the side of the barrier, the projecting member being adjustable to engage and disengage the sides of the passageway.

The projecting member is preferably a rod having a plastics material or rubber face located at the distal end thereof to engage the sides of the passageway, or, in the case of the further clamping means, to the frame assembly. The clamping means preferably has means to effect extension and retraction of the rod.

The barrier preferably has a plurality of vertical rods fixed to the frame assembly to prevent children climbing through the frame assembly.

Preferably the barrier is constructed from tubular steel pipes and also has metallic feet fixed to the lower frame element to contact the floor, thereby giving ground clearance to the lower barrier clamping means.

The upper part of the gate may lie below the upper level of the remainder of the frame in which case the clamp or clamps associated with the gate may be positioned below the level of other clamps associated with the upper part of the frame. Nonetheless the gate clamp or clamps still act to increase the rigidity of the structure as a whole.

Various embodiments of the invention will now be described by way of example and with reference to the accompanying drawings in which.

Figure 1:
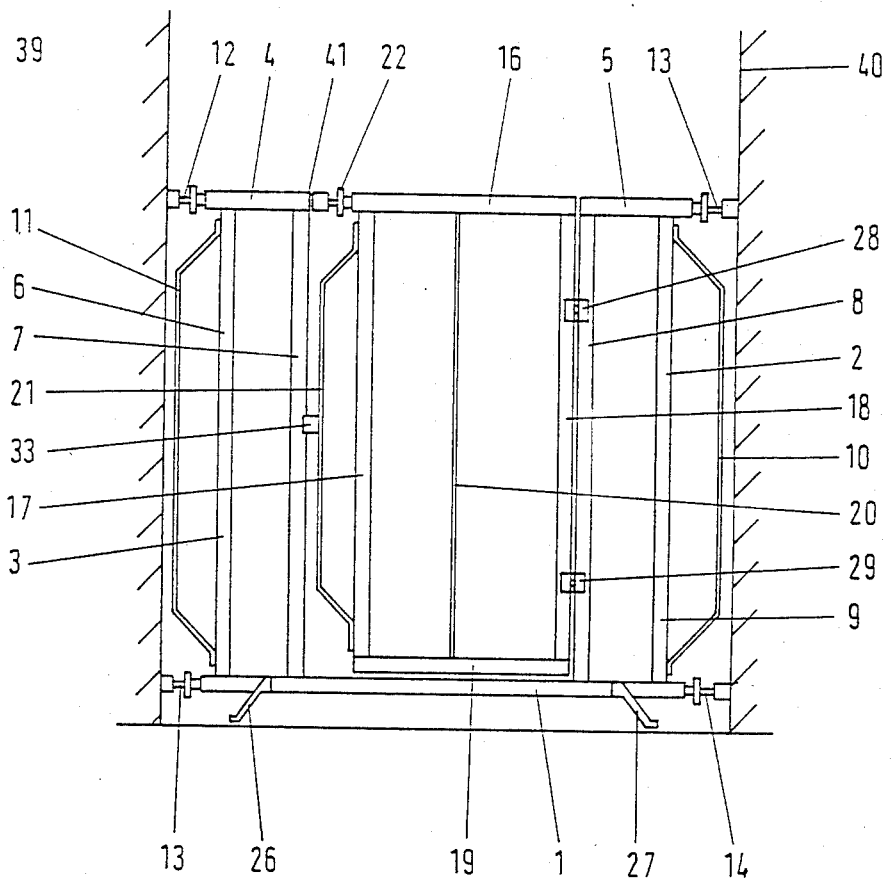
FIG. 1 shows the safety barrier with access gate positioned across a doorway.
Figure 2:
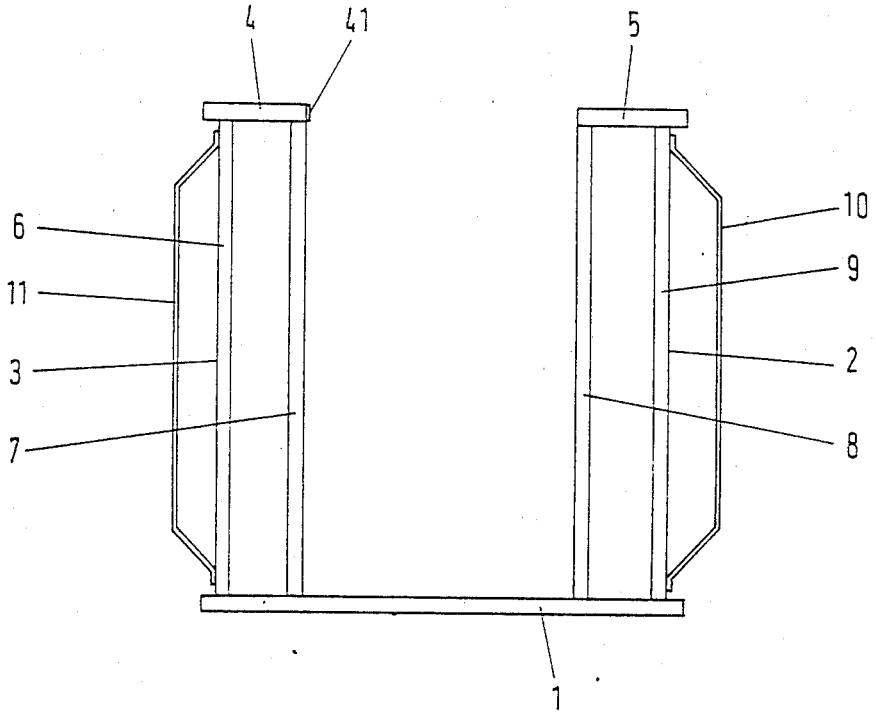
FIG. 2 shows barrier without access gate.
Figure 3:
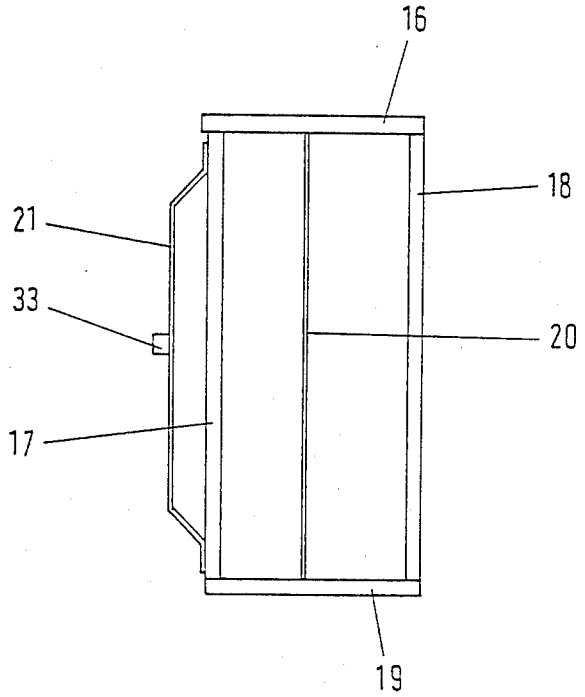
FIG. 3 shows gate of the safety barrier.
Figure 6:
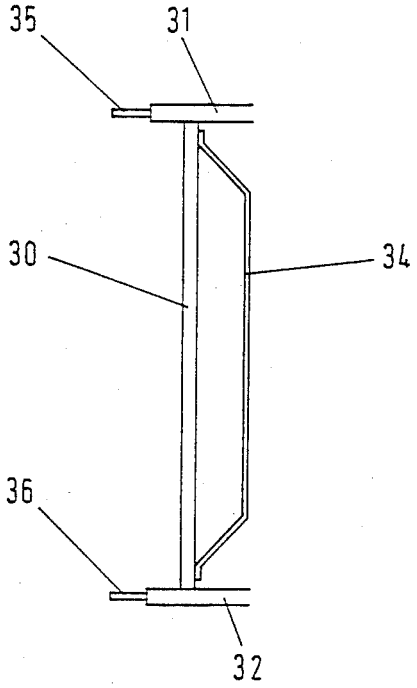

FIG. 6 shows safety barrier extension to increase the width of the barrier; and Referring to the accompanying drawings, a safety barrier in accordance with the present invention is constructed of tubular rods, preferably steel pipes. This gives it rigidity as well as light weight. The safety barrier, as shown in FIGS. 1 and 2, is constructed with a long tubular rod 1 and two rectangles 2 and 3 formed at both ends by welding together items 4, 5, 6, 7, 8 and 9. Rod 1 is bent slightly inwardly at the centre which causes the tops of rectangles 2 and 3 to project outwardly at the top which results in extra tightness of the barrier within the passageway. The gate shown in FIG. 3 is constructed by welding together 16, 17, 18 and 19. The gap between 17 and 18 is narrowed by welding a light weight rod 20 in the middle. Bracket-shaped structures 10 and 11 are welded at the outer sides of the rectangles 2 and 3, another bracket 21 is welded on vertical side 17 of the gate. The brackets are made of light weight rods. The plane of the brackets falls within the planes of the clamps fitted on the frame. The gate as shown in FIG. 3 is mounted in the safety barrier, as shown in FIG. 1 with the help of hinges 28 and 29. The gate is mounted in such a way that the vertical sides 18 and 8 are closely juxtaposed. The catch 33 prevents the gate from swinging freely and to the other side; various types of catches and locks could be used.

Figure 4:
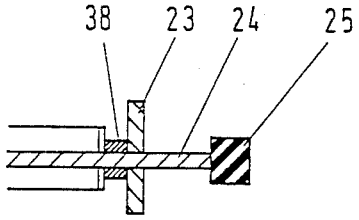
FIG. 4 shows cross-section of clamps used in safety barrier and its gate.

Four clamps 12, 13, 14 and 15 are mounted one at each corner of the barrier. A fifth clamp 22 is mounted on the top corner of the gate. A flat circular plate 41 is welded on the inner side of the pipe 4. The clamps as shown in FIG. 4 comprise a threaded shank 24 which is mounted on the frame with the help of a bush 38. The threaded shank 24 passes through the threaded centre of the turning knob 23. At the end of the shank 24 a rubber or plastic face 25 is mounted. When the knob is turned the shank 24 and rubber face 25 move outwardly away from the frame exerting outward compressive pressure thus giving correct tightness.

Figure 5:
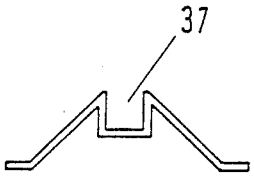
FIG. 5 shows side view of the legs on which the safety barrier stands.

The gate stands on two feet 26 and 27 as shown in FIG. 1. The feet raise the barrier above the ground so that the clamps 15 and 14 can be turned freely. The feet are constructed of metal plates formed to take the shape shown in FIG. 5. The barrier stands in the central depression 37. The feet are either screwed or welded on the barrier.

The width of the gate could be extended by mounting the extension, as shown in FIG. 6. The extension is constructed by welding together a long vertical tubular rod 30 and two small horizontal rods 31 and 32. A bracket 34 is welded on 30. Two rods 35 and 36 are welded on 31 and 32, and these rods gently slip in and fit on the corners of the barrier, where clamps are mounted. In order to extend the width of the barrier clamps 13 and 14 or 12 and 15 would be removed and replaced on the ends of 31 and 32. The rods 35 and 36 will be slipped in 5 and 1 or 4 and 1. The clamps are able to extend from their retracted position by a length equal to at least half the width of the extension. The combination of clamps and extensions thus allows the barrier to fit exactly into any width of passageway.

In order to use the gate it is positioned between walls and the shanks of the clamps 12,13,14 and 15 are pulled away from the frame until rubber face 25 engage the walls. The barrier is now tightened by turning knob 23; as the knob is turned the shank 24 moves outward away from the frame and so does the rubber face 25, tightening against the walls. A similar procedure is applied when closed the door using clamp 22, in this case the rubber face of the clamp tightens against the flat surface 41 of the frame 4. Clamps 12, 13, 14 and 15 enable the barrier to be positioned in a non-uniform passageway. For instance, if the width of the passageway is greater at the bottom of the barrier than at the top, then clamps 14, 15 (the bottom clamps) are simply extended further than clamps 12, 13 so that they can engage the wider part of the passageway.

The door of the safety barrier swings easily on the hinges. When passage is required through the barrier clamp 22 will be loosened by turning the knob. The gate will be pushed away allowing passage through the barrier. After passage the gate can be closed by swinging it back into the closed position and tightening it in place by turning the knob of the clamps 22.

It should be appreciated that the above described arrangement of three clamps on an upper frame element and two clamps on a lower frame element give the overall arrangement great rigidity, when the gate is closed. When clamp 22 is tightened it pushes the rectangular frame outwardly and clamps 12 and 13 push the rectangular frame inwardly. The combined forces exerted by clamps 12, 13 and 22 result in a tight fitting of the barrier within a passageway. The upper frame element 4, 16, 5 behaves as a single length of rod in the same way as the integral bottom rod 1.

The combined forces of upper and lower barrier clamping means and the gate clamping means results in tightness of the barrier in a passageway which is uniform throughout its structure.

When the door of the barrier is open the two lower clamps 14, 15 and the two upper clamps 12, 13 hold the frame firmly in position in the passageway.

I claim:

1. A child safety barrier intended for positioning between two upright support surfaces so as to extend therebetween, the barrier comprising:

a frame assembly of substantially rectangular structure having upper and lower elongate frame elements each intended to extend between the two support surfaces;

independently adjustable clamping means provided at each corner of said frame assembly for securing the barrier in position; and a gate mounted in the frame assembly for movement between an open position allowing access through the barrier and a closed position in which the gate forms an integral part of the barrier;

in which:

the frame assembly comprises two co-planar rectangular frame members separated in their common plane but interconnected by said lower frame element;

the gate is hingedly mounted on one of said rectangular frame members and is capable of being clamped to the other of said rectangular frame members when the gate is in its closed position; and further clamping means provided on said gate for clamping engagement with the upper end of said other rectangular frame member, said further clamping means being operable to urge apart the upper ends of said rectangular frame members so as to counteract the tendency of the frame assembly the bend inwardly due to the action of the clamping means at the corners of the frame assembly and so as to increase the overall stability of the barrier.

2. A barrier according to claim 1, in which the lower elongate frame element is slightly bowed in an upward direction, so that the rectangular frame members extend slightly divergently upwardly from the lower frame element.

3. A barrier according to claim 1 which is laterally extendable by means of an extension member connectable to a side thereof, the combination of extension member and the clamping means at the corners of the frame assembly resulting in the ability of the barrier to be accommodated in passageways of varying, and non-uniform, widths.

4. A barrier according to claim 1, in which the clamping means provided at each corner of the frame assembly comprises a member projecting laterally from the respective side of the barrier, said projecting member being adjustable to engage and disengage the respective support surface.

5. A barrier according to claim 4, in which each clamping means comprises a rod extending from the respective side of the frame assembly, said rod having a rubber or plastics material face located at the distal end thereof to engage the respective support surface, or, in the case of said further clamping means to the respective rectangular frame member, thereby exerting outward compressive pressure thereon, said clamping means having means to effect extension and retraction of said rod.

6. A barrier according to claimm 1, in which the top setion of the gate forms part of said upper elongate frame element, when said gate is in its closed position.

7. A barrier according to claim 1, in which a plurality of laterally spaced vertical rods are fixed to the frame assembly.

8. A barrier according to claim 1, including metallic feet fixedly attached to the lower elongate frame element for contacting the floor, thereby giving ground clearance to the clamping means located one at either end of said lower frame element.

9. A barrier according to claim 1, in which the frame assembly is constructed from tubular steel pipes.

* * * * *